US009901970B2

(12) United States Patent
Nakamura et al.

(10) Patent No.: US 9,901,970 B2
(45) Date of Patent: Feb. 27, 2018

(54) FORMED MATERIAL MANUFACTURING METHOD

(71) Applicant: NISSHIN STEEL CO., LTD., Tokyo (JP)

(72) Inventors: Naofumi Nakamura, Osaka (JP); Yudai Yamamoto, Osaka (JP); Katsuhide Nishio, Osaka (JP)

(73) Assignee: NISSHIN STEEL CO., LTD., Tokyo (JP)

( * ) Notice: Subject to any disclaimer, the term of this patent is extended or adjusted under 35 U.S.C. 154(b) by 0 days.

(21) Appl. No.: 14/782,848

(22) PCT Filed: Nov. 7, 2014

(86) PCT No.: PCT/JP2014/079527

§ 371 (c)(1),
(2) Date: Oct. 7, 2015

(87) PCT Pub. No.: WO2015/177946

PCT Pub. Date: Nov. 26, 2015

(65) Prior Publication Data

US 2016/0144418 A1 May 26, 2016

(30) Foreign Application Priority Data

May 19, 2014 (JP) ..... 2014-102968
Sep. 4, 2014 (JP) ..... 2014-180047

(51) Int. Cl.
*B21D 24/00* (2006.01)
*B21D 22/30* (2006.01)
(Continued)

(52) U.S. Cl.
CPC ..... *B21D 24/00* (2013.01); *B21D 22/26* (2013.01); *B21D 22/28* (2013.01); *B21D 22/30* (2013.01)

(58) Field of Classification Search
CPC ..... B21D 22/28; B21D 24/14; B21D 24/005; B21D 24/02; B21D 24/06; B21D 24/08; B21D 24/00; B21D 22/26; B21D 22/30
(Continued)

(56) References Cited

U.S. PATENT DOCUMENTS 4,263,800 A * 4/1981 Arfert ..... B21D 22/28 72/349
5,687,598 A * 11/1997 Kirii ..... B21D 24/14 72/21.5
6,568,064 B2 * 5/2003 Kanno ..... H02K 1/17 72/348

FOREIGN PATENT DOCUMENTS

JP 60-146526 U 9/1985
JP 4-43415 U 4/1992
(Continued)

OTHER PUBLICATIONS

Office Action issued in Japanese Patent Application No. 2014-180047 dated Nov. 25, 2014 along with English translation, 10 pages.

*Primary Examiner* — R. K. Arundale
*Assistant Examiner* — Pradeep C Battula
(74) *Attorney, Agent, or Firm* — Rothwell, Figg, Ernst & Manbeck, P.C.

(57) ABSTRACT

A formed material having a tubular body and a flange formed at an end of the body is manufactured by multistage drawing of a blank metal sheet. The multistage drawing includes preliminary drawing in which a preliminary body having a body preform is formed from the blank metal sheet, and at least one compression drawing which is performed after the preliminary drawing and in which the body is formed by drawing the body preform while applying a compressive force to the body preform. The at least one compression drawing is performed so as to be completed
(Continued)

before the pad portion of pressurization means reaches bottom dead center, and a support force supporting the pad portion acts as the compressive force upon the body preform when the body preform is drawn.

3 Claims, 7 Drawing Sheets

(51) Int. Cl.
*B21D 22/26* (2006.01)
*B21D 22/28* (2006.01)

(58) Field of Classification Search
USPC ..... 72/348
See application file for complete search history.

(56) References Cited

FOREIGN PATENT DOCUMENTS

| | | | |
|---|---|---|---|
| JP | 2000-5827 | A | 1/2000 |
| JP | 2013-51765 | A | 3/2013 |

* cited by examiner

FORMED MATERIAL MANUFACTURING METHOD

CROSS REFERENCE TO RELATED APPLICATIONS

This application is a 35 U.S.C. § 371 National Phase Entry Application from PCT/JP2014/079527, filed Nov. 7, 2014, and designating the United States, which claims priority under 35 U.S.C. § 119 to Japanese Patent Application No. 2014-102968 filed May 19, 2014 and to Japanese Patent Application No. 2014-180047 filed Sep. 4, 2014, which are incorporated herein by reference in their entireties.

TECHNICAL FIELD

The present invention relates to a formed material manufacturing method for manufacturing a formed material having a tubular body and a flange formed at the end of the body.

BACKGROUND ART

As disclosed, for example, in Non-Patent Document 1 and so on, a formed material having a tubular body and a flange portion formed on an end portion of the body is manufactured by performing a drawing process. Since the body is formed by stretching a blank metal sheet in the drawing process, the thickness of the circumferential wall of the body is usually less than that of the blank sheet. On the other hand, since the region of the metal sheet corresponding to the flange shrinks as a whole in response to the formation of the body, the flange thickness is larger than that of the blank sheet.

The abovementioned formed material can be used as the motor case disclosed, for example, in Patent Document 1 and so on. In this case, the circumferential wall of the body is expected to function as a shielding material that prevents magnetic leakage to the outside of the motor case. In some motor structures, the circumferential wall is also expected to function as a back yoke of a stator. The performance of the circumferential wall as the shield material or back yoke is improved as the thickness thereof increases. Therefore, when a formed material is manufactured by drawing, as described hereinabove, a blank metal sheet with a thickness larger than the necessary thickness of the circumferential wall is selected in consideration of the reduction in thickness caused by the drawing process. Meanwhile, the flange is most often used for mounting the motor case on the mounting object. Therefore, the flange is expected to have a certain strength.

With the abovementioned conventional formed material manufacturing method, a formed material having a tubular body and a flange formed at the end of the body is manufactured by drawing. Therefore, the flange thickness becomes larger than the blank sheet thickness. As a result, the thickness required for the flange to demonstrate the expected performance is sometimes exceeded and the flange becomes unnecessarily thick. Further, as a result of selecting a blank metal sheet with a thickness larger than the required thickness of the circumferential wall of the body, the thickness is unnecessarily increased up to that of the top wall of the body which makes little contribution to the motor performance. This means that the formed material is unnecessarily increased in weight and becomes unsuitable for applications that require lightweight motor cases. Further, with the conventional method, since a comparatively thick blank metal material is used, the material cost is increased.

Accordingly, Patent Document 2 and so on disclose a mold for performing compression drawing in a multistage drawing process as means for preventing the body of the drawn member from thinning.

In the compression drawing mold, a cylindrical member molded in a preceding step is fitted, in a state in which the opening flange portion thereof faces downward, onto a deformation-preventing member provided in a lower mold, the opening flange portion is positioned in a plate recess provided in the lower mold, and the outer periphery thereof is engaged with the recess. An upper mold is then lowered and the cylindrical portion of the cylindrical member is press fitted into a die hole provided in the upper mold, thereby inducing a compressive force and performing the compression drawing processing.

Since the deformation-preventing member in this case can be moved in the vertical direction with respect to the plate, the side wall of the cylindrical member receives practically no tensile force and can be prevented from thinning.

The compressive force applied in this case to a body preform is equal to the deformation resistance of the body preform at the time of press fitting into the die hole. Thus, the factors contributing to thickening are the mold clearance between the die and the punch, the die shoulder radius, and the material strength [(proof stress)×(cross-sectional area)] of the body preform which mainly relate to deformation resistance.

Non-Patent Document 1: "Basics of Plastic Forming", Masao Murakawa and three others, First Edition, SANGYO-TOSHO Publishing Co. Ltd., Jan. 16, 1990, pp. 104 to 107

Patent Document 1: Japanese Patent Application Publication No. 2013-51765

Patent Document 2: Japanese Patent Application Publication No. H4-43415

DISCLOSURE OF THE INVENTION

However, with the compression drawing method such as described hereinabove, the cylindrical member is placed on a plate which is fixed to the lower mold, the cylindrical member is squeezed between the plate and the die which is lowered from above, and the compressive force acts in the so-called bottomed state and increases the sheet thickness. Therefore, the compressive force applied to the body preform is equal to the deformation resistance of the body preform that is generated during the press fitting into the die hole.

The factors contributing to thickening are the mold clearance between the die and the punch, the die shoulder radius, and the material strength [(proof stress)×(cross-sectional area)] of the body preform which mainly relate to deformation resistance, and the deformation resistance generated in the body preform increases when press fitting into the die hole is difficult to perform. For example, where the mold clearance is considered by way of example, when the mold clearance is increased in order to obtain a thick body preform, press fitting into the die hole is facilitated and the increase in thickness is, conversely, decreased. Thus, with the conventional compression drawing method implemented in the bottomed state, the thickness cannot be increased to that equal to the mold clearance. Furthermore, where the above-described conditions contributing to the increase in thickness have once been determined, they are difficult to change. Therefore, it is practically impossible to control the degree of thickness increase during the operation.

The present invention has been created to resolve the abovementioned problems, and it is an object of the present invention to provide a formed material manufacturing method by which unnecessary thickening of the flange and top wall can be avoided, the method being flexibly adaptable to changes in processing conditions or blank metal sheet thickness and capable of efficiently reducing the formed material in weight and material cost.

The formed material manufacturing method in accordance with the present invention is a formed material manufacturing method of manufacturing a formed material having a tubular body and a flange, which is formed at an end portion of the body, by performing multistage drawing of a blank metal sheet, wherein the multistage drawing includes: preliminary drawing in which a preliminary body having a body preform is formed from the blank metal sheet; and at least one compression drawing which is performed after the preliminary drawing by using a mold including a die having a press-in hole, a punch inserted into the body preform to press the body preform into the press-in hole, and pressurization means for applying a compressive force along a depth direction of the body preform to the body preform, and in which the body is formed by drawing the body preform while applying the compressive force to the body perform; the pressurization means is a lifter pad having a pad portion which is disposed at the outer circumferential position of the punch so as to face the die and onto which the body preform is placed, and a support portion which supports the pad portion from below and which is configured such that a support force that supports the pad portion can be adjusted; at least one compression drawing is performed to be completed before the pad portion reaches bottom dead center; and the support force acts as the compression force upon the body preform when the drawing of the body preform is performed.

With the formed material manufacturing method in accordance with the present invention, the body is formed by drawing the body preform while applying the compressive force along the depth direction of the body preform to the body preform. As a result, thickness reduction of the circumferential wall of the body caused by the drawing process can be avoided, and the necessary thickness of the circumferential wall can be ensured even by using a blank metal sheet which is thinner than that in conventional methods. Further, since at least one compression drawing is performed such as to be completed before the pad portion reaches bottom dead center, and the adjustable support force of the support portion acts as the compressive force upon the body preform when the body preform is drawn, even when the processing conditions are changed or the thickness of the blank metal sheet is changed, the process can be flexibly adapted to those changes. As a result, unnecessary increases in the thickness of the flange and the top wall can be avoided, the process can be flexibly adapted to changes in the processing conditions or thickness of the blank metal sheet, and the formed material can be efficiently reduced in weight and material cost.

BEST MODE FOR CARRYING OUT THE INVENTION

Embodiments of the present invention will be explained hereinbelow with reference to the drawings.

Embodiment 1

Figure 1:
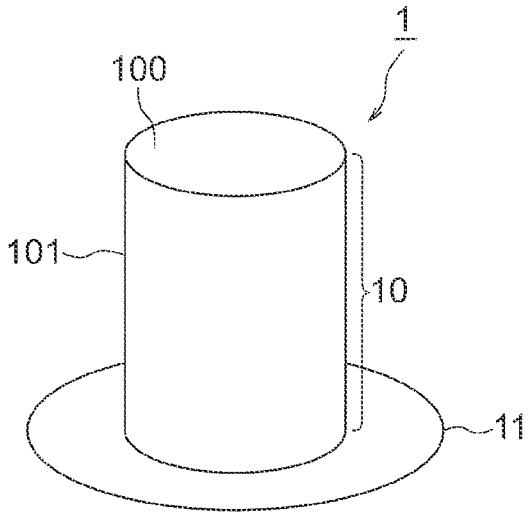
FIG. 1 is a perspective view of a formed material 1 manufactured by a formed material manufacturing method according to Embodiment 1 of the present invention.

FIG. 1 is a perspective view of the formed material 1 manufactured by the formed material manufacturing method according to Embodiment 1 of the present invention. As depicted in FIG. 1, the formed material 1 manufactured by the formed material manufacturing method of the present embodiment has a body 10 and a flange 11. The body 10 is a tubular part having a top wall 100 and a circumferential wall 101 extending from the outer edge of the top wall 100. Depending on the targeted use of the formed material 1, the top wall 100 can also be referred to as a bottom wall or the like. In FIG. 1, the body 10 is depicted as having a round cross section, but the body 10 may also have another cross-sectional shape, for example, an elliptical or angular cross section. The top wall 100 can also be further processed, for example, to form a projection further protruding from the top wall 100. The flange 11 is a plate-shaped portion formed at the end of the body 10 (end of the circumferential wall 101).

Figure 2:
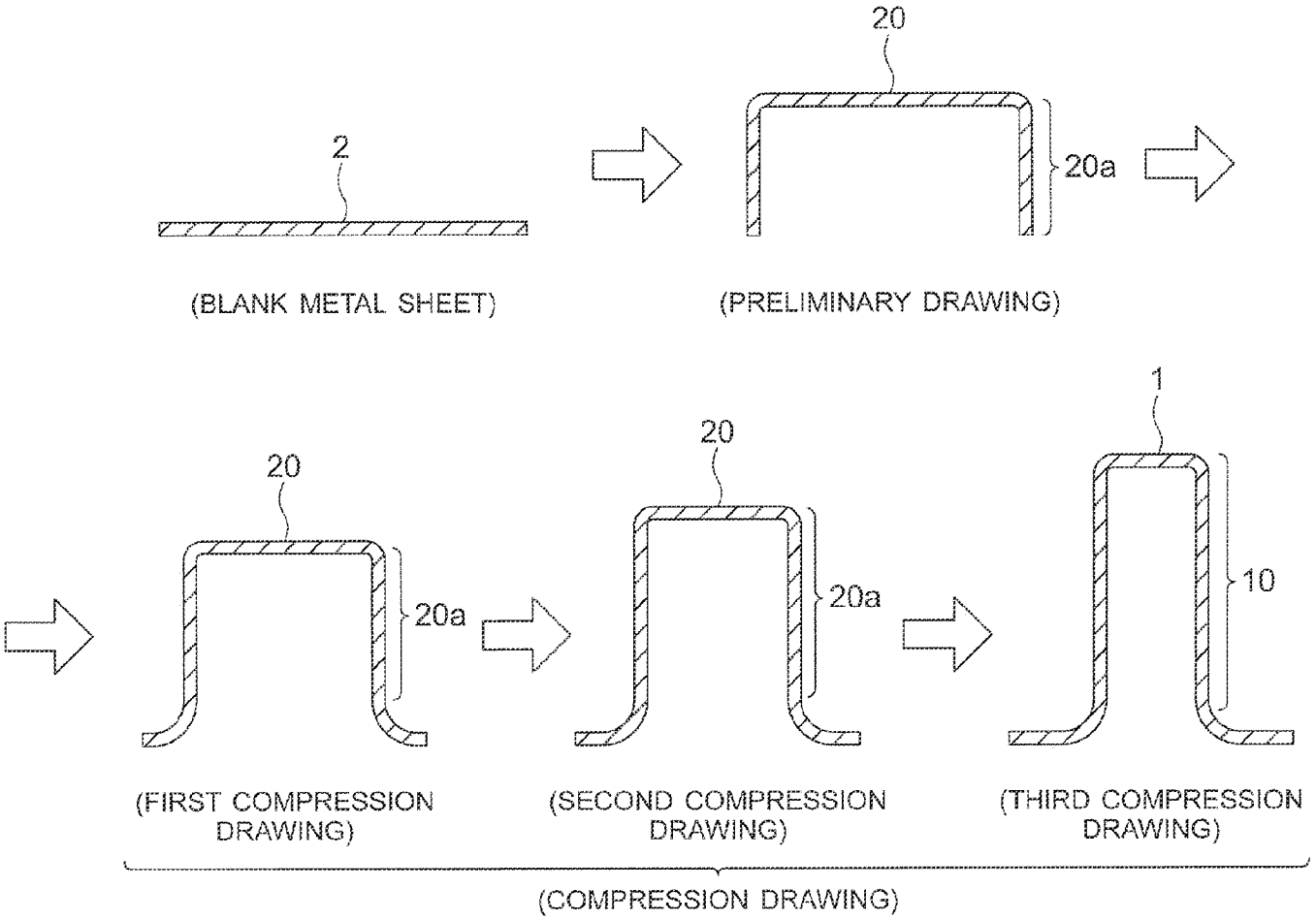
FIG. 2 illustrates a formed material manufacturing method for manufacturing the formed material depicted in FIG. 1.

FIG. 2 illustrates the formed material manufacturing method for manufacturing the formed material 1 depicted in FIG. 1. With the formed material manufacturing method in accordance with the present invention, the formed material 1 is manufactured by multistage drawing of a flat blank metal sheet 2. The multistage drawing includes preliminary drawing and at least one cycle of compression drawing performed after the preliminary drawing. In the formed material manufacturing method in accordance with the present embodiment, three cycles of compression drawing are performed (first to third compression drawings). A variety of metal sheets such as cold-rolled steel sheets, stainless steel sheets, and plated steel sheets can be used.

The preliminary drawing is a step for forming a preliminary body 20 having a body preform 20*a* by subjecting the blank metal sheet 2 to drawing. The body preform 20*a* is a tubular body with a diameter larger and a depth smaller than those of the body 10 depicted in FIG. 1. The depth direction of the body preform 20*a* is defined by the extension direction of the circumferential wall of the body preform 20*a*. In the present embodiment, the entire preliminary body 20 constitutes the body preform 20*a*. However, a body having a flange may also be formed as the preliminary body 20. In this case, the flange does not constitute the body preform 20*a*.

As will be described hereinbelow in greater detail, the first to third compression drawing are the steps for forming the body 10 by drawing the body preform 20*a* while applying a compressive force 42*a* along the depth direction (see FIG. 5) of the body preform 20*a* to the body preform 20*a*. Drawing of the body preform 20*a* means reducing the diameter of the body preform 20*a* and further increasing the depth of the body preform 20*a*.

Figure 3:
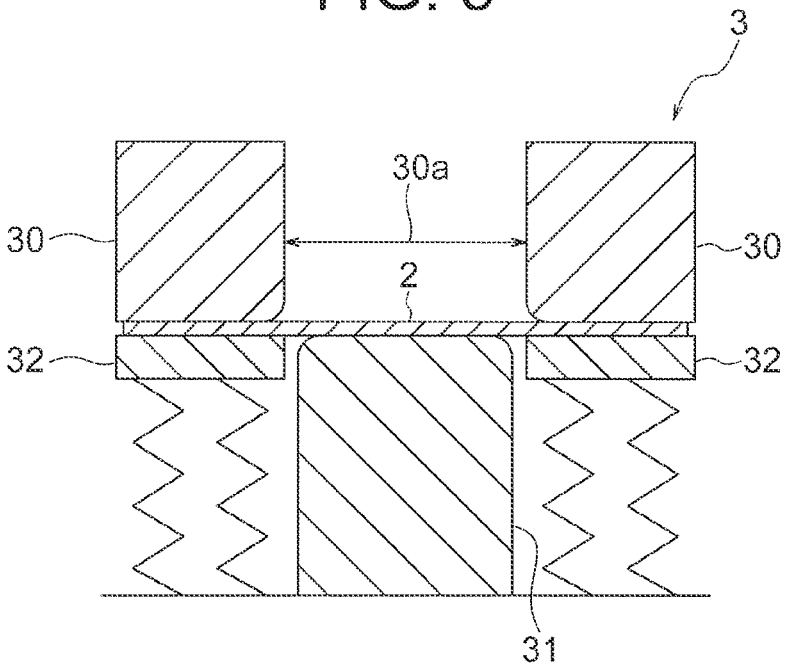
FIG. 3 illustrates a mold which is used in the preliminary drawing depicted in FIG. 2.
Figure 4:
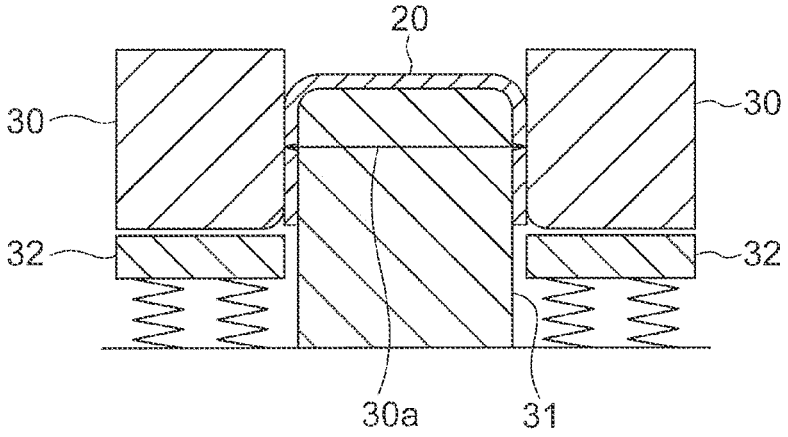
FIG. 4 illustrates the preliminary drawing performed with the mold depicted in FIG. 3.

FIG. 3 illustrates a mold 3 which is used in the preliminary drawing depicted in FIG. 2, and FIG. 4 illustrates the preliminary drawing performed with the mold 3 depicted in FIG. 3. As depicted in FIG. 3, the mold 3 which is used in the preliminary drawing includes a die 30, a punch 31, and a cushion pad 32. The die 30 is provided with a press-in hole 30*a* into which the blank metal sheet 2 is pressed together with the punch 31. The cushion pad 32 is disposed at the outer circumferential position of the punch 31, so as to face the end surface of the die 30. As depicted in FIG. 4, in the preliminary drawing, the outer edge portion of the blank metal sheet 2 is not fully restrained by the die 30 and the cushion pad 32, and the outer edge portion of the blank metal sheet 2 is drawn till it is released from the restraint by the die 30 and the cushion pad 32. The entire blank metal sheet 2 may be pressed together with the punch 31 into the press-in hole 30*a* and drawn. As mentioned hereinabove, where the preliminary body 20 having a flange is formed, the drawing may be stopped at a depth at which the outer edge portion of the blank metal sheet 2 is still restrained by the die 30 and the cushion pad 32.

Figure 5:
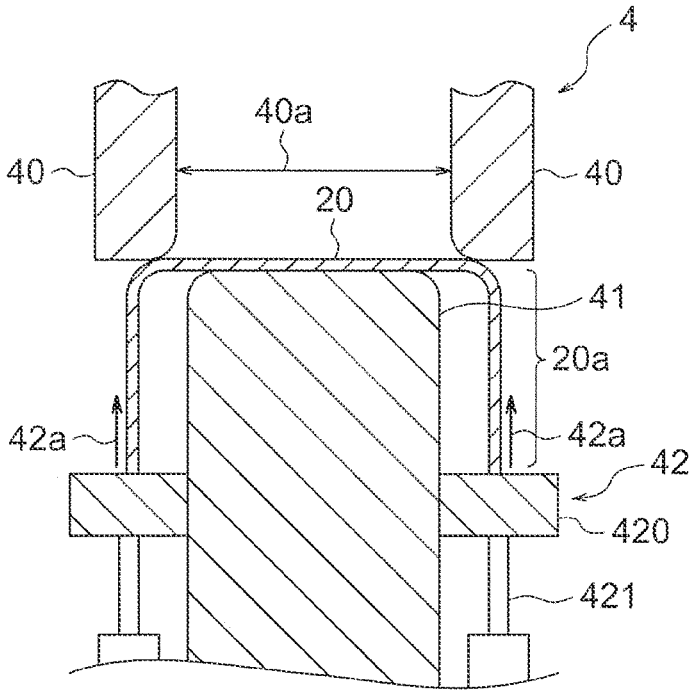
FIG. 5 illustrates a mold that is used in the first compression drawing depicted in FIG. 2.
Figure 6:
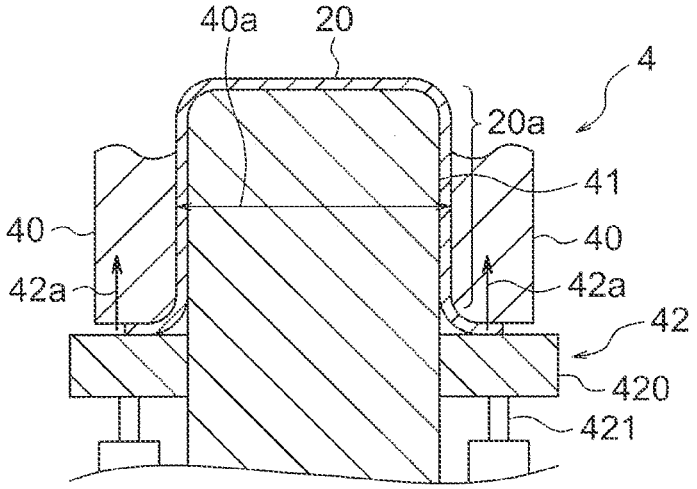
FIG. 6 illustrates the first compression drawing performed with the mold depicted in FIG. 5.

FIG. 5 illustrates a mold 4 that is used in the first compression drawing depicted in FIG. 2. FIG. 6 illustrates the first compression drawing performed with the mold 4 depicted in FIG. 5. As depicted in FIG. 5, the mold 4 that is used in the first compression drawing includes a die 40, a punch 41, and a lifter pad 42. The die 40 is a member having a press-in hole 40*a*. The punch 41 is a round columnar body which is inserted into the body preform 20*a* and presses the body preform 20*a* into the press-in hole 40*a*.

The lifter pad 42 is disposed at the outer circumferential position of the punch 41 so as to face the die 40. More specifically, the lifter pad 42 has a pad portion 420 and a support portion 421. The pad portion 420 is an annular member disposed at the outer circumferential position of the punch 41 so as to face the die 40. The support portion 421 is disposed below the pad portion 420 and supports the pad portion 420. The support portion 421 is constituted, for example by a hydraulic or pneumatic cylinder and configured such that the support force (lifter pressure) that supports the pad portion 420 can be adjusted.

The body preform 20*a* is placed on the pad portion 420. The circumferential wall of the body preform 20*a* is grasped by the die 40 and the pad portion 420 when the die 40 is lowered. The support force of the support portion 421 is a resistance force which acts against the lowering of the die 40 when the body preform 20*a* is drawn, and acts upon the body preform 20*a* as a compressive force 42*a* along the depth direction for the body preform 20*a*. Thus, the lifter pad 42 constitutes a pressuring means for applying the compressive force 42*a* along the depth direction of the body preform 20*a* to the body preform 20*a*.

As depicted in FIG. 6, in the first compression drawing, as a result of lowering the die 40, the body preform 20*a* is pressed together with the punch 41 into the press-in hole 40*a* and the body preform 20*a* is drawn. Such a first compression drawing is performed to be completed before the pad portion 420 reaches bottom dead center. Bottom dead center of the pad portion 420, as referred to herein, means a position at which the lowering of the pad portion 420 is mechanically restricted. This position is defined by the structure of the support portion 421 or the position of the member restricting the lowering of the pad portion 420. In other words, the first compression drawing is performed such that the pad portion 420 does not bottom. As a result of performing the first compression drawing to be completed before the pad portion 420 reaches bottom dead center, the support force of the support portion 421 acts as the compressive force 42*a* upon the body preform 20*a* in the course of the first compression drawing. Thus, in the first compression drawing, the body preform 20*a* is drawn while the compressive force 42*a* is applied. Since the support portion 421 is configured such that the support force can be adjusted, as mentioned hereinabove, the compressive force 42*a* can be adjusted by adjusting the support force. As will be explained hereinbelow in greater detail, where the compressive force 42*a* fulfils a predetermined condition, the body preform 20*a* can be drawn without causing buckling or thickness reduction in the body preform 20*a*. As a result, the thickness of the body preform 20*a* that has been subjected to the first compression drawing is equal to or greater than the thickness of the body preform 20*a* before the first compression drawing.

Where the first compression drawing is performed after the pad portion 420 has reached bottom dead center, the deformation resistance of the body preform 20*a* which occurs when the body preform 20*a* is pressed into the press-in hole 40*a* acts as a compressive force upon the body preform 20*a*. This compressive force is defined by a mold clearance, a die shoulder radius, and the material strength of the body preform 20*a* and is difficult to adjust. Thus, by using the configuration in which, as in the present embodiment, the drawing is completed before the pad portion 420 reaches bottom dead center, it is possible to easily adjust the compressive force 42*a* by adjusting the support force of the support portion 421, and the increase/decrease in thickness of the body preform 20*a* can be easily controlled by the compressive force 42*a*.

The second and third compression drawings depicted in FIG. 2 are performed using a mold having a configuration similar to that of the mold 4 depicted in FIGS. 5 and 6. However, the dimensions of the die 40 or the punch 41 are changed as appropriate. In the second compression drawing, the body preform 20*a* after the first compression drawing is drawn while applying the compressive force 42*a*. Further, in the third compression drawing, the body preform 20*a* after the second compression drawing is drawn while applying the compressive force 42*a*. The second and third compression drawings are each performed to be completed before the pad portion 420 reaches bottom dead center.

The body preform 20*a* is formed into the body 10 by such first to third compression drawings. The thickness of the circumferential wall 101 of the body 10 is preferably equal to or greater than at least one of the maximum thickness of the top wall 100 of the body 10 and the thickness of the blank metal sheet 2.

Figure 7:
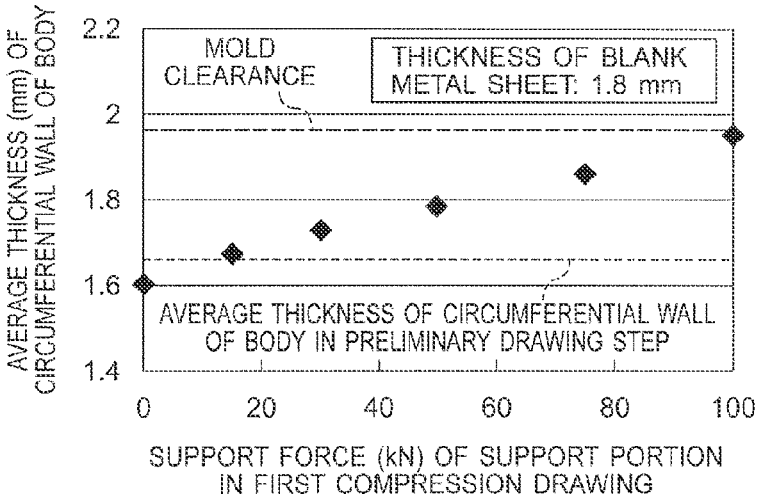
FIG. 7 is a graph illustrating the relationship between the support force of a support portion in the first compression drawing and the average thickness of the circumferential wall of the body.
Figure 8:
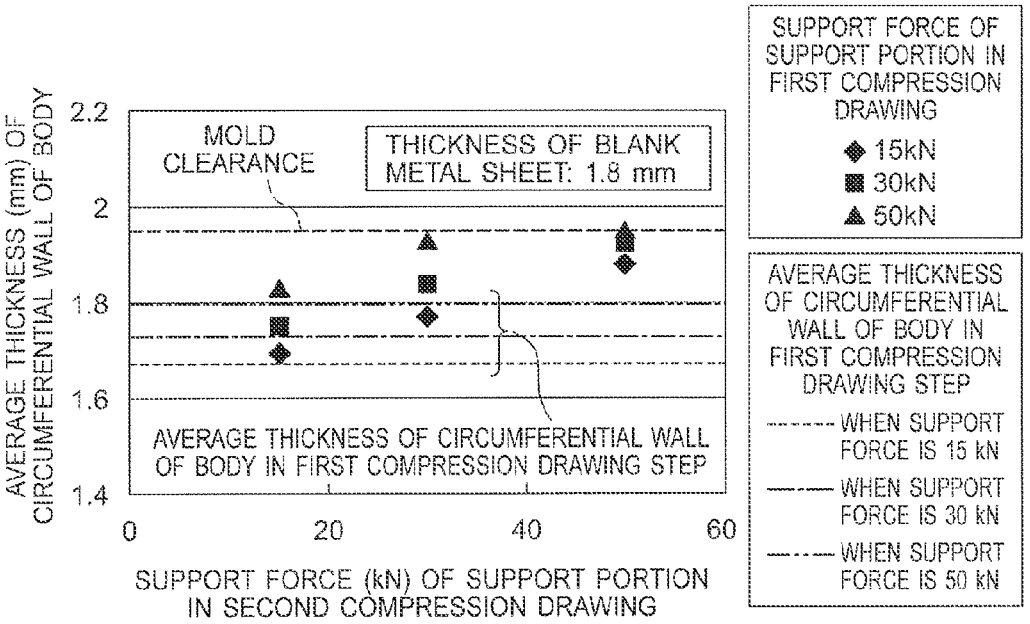
FIG. 8 is a graph illustrating the relationship between the support force of the support portion in the second compression drawing and the average thickness of the circumferential wall of the body.
Figure 9:
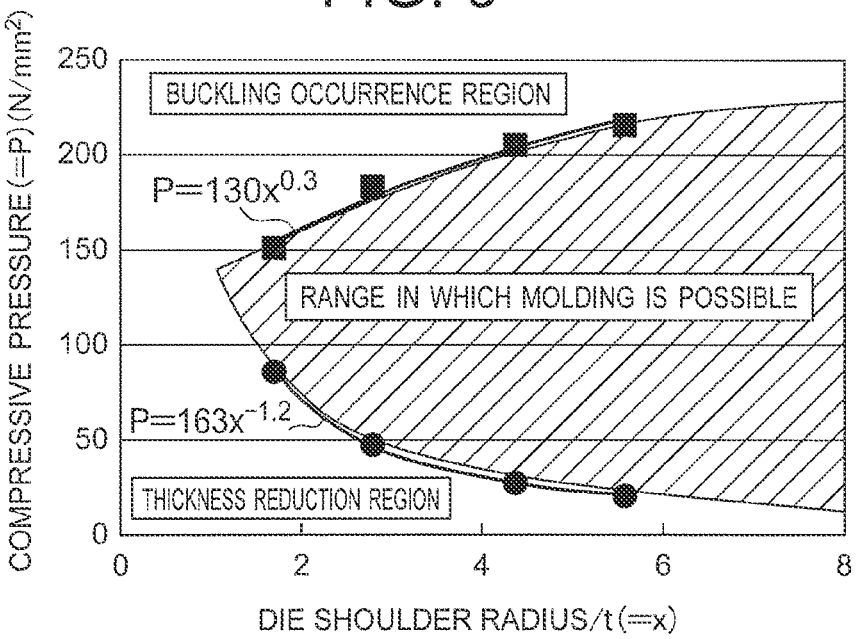
FIG. 9 is a graph illustrating the relationship between the value of the compressive pressure during the compression drawing, the die shoulder radius, and the thickness of the body preform.

An example is described hereinbelow. The inventors used round sheets (thickness 1.6 mm, 1.8 mm, and 2.0 mm, diameter 116 mm) of cold-rolled sheets of common steel that were plated with Zn—Al—Mg as the blank metal sheet 2, and investigated the relationship between the value of the support force (compressive force 42*a*) of the support portion 421 during the compression drawing and the average thickness (mm) of the circumferential wall of the body portion of the body preform 20*a*. The relationship between the value of the compressive force 42*a* during the compression drawing, the die shoulder radius (mm), and the thickness (mm) of the body preform 20*a* was also examined. The following processing conditions were used in this process. The results are shown in FIGS. 7 to 9.

Curvature radius of die shoulder: 3 mm to 10 mm.

Diameter of punch: 66 mm in the preliminary drawing, 54 mm in the first compression drawing, 43 mm in the second compression drawing, and 36 mm in the third compression drawing.

Support force of the support portion 421: 0 kN to 100 kN.

Press oil: TN-20N.

FIG. 7 is a graph illustrating the relationship between the support force of the support portion 421 in the first compression drawing and the average thickness of the circumferential wall of the body. In FIG. 7 the average thickness of the circumferential wall of the body after the first compression drawing is plotted against the ordinate, and the support force (kN) of the support portion 421 in the first compression drawing is plotted against the abscissa. The average thickness of the circumferential wall of the body as referred to herein, is obtained by averaging the thickness of the circumferential wall from the R-stop of the punch shoulder radius on the flange side to the R-stop of the punch shoulder radius on the top wall side.

It is clear from FIG. 7 that the average thickness of the circumferential wall of the body increases linearly with the increase in the support force of the support portion 421 in the first compression drawing. It is also clear that where the support force of the support portion 421 in the first compression drawing is made equal to or greater than about 15 kN, the average thickness of the circumferential wall of the body is increased over that in the preliminary drawing step, which is the previous step.

FIG. 8 is a graph illustrating the relationship between the support force of the support portion 421 in the second compression drawing and the average thickness of the circumferential wall of the body. In FIG. 8 the average thickness of the circumferential wall of the body after the second compression drawing is plotted against the ordinate, and the support force (kN) of the support portion 421 in the second compression drawing is plotted against the abscissa. In the second compression drawing, the average thickness of the circumferential wall of the body increases linearly with the increase in the support force of the support portion 421 in the same manner as in the first compression drawing.

However, when the body preform 20*a*, which was molded by a support force of 50 kN of the support portion 421 in the first compression drawing, was acted upon by the support force of about 30 kN of the support portion 421 in the second compression drawing, the sheet thickness was increased to that substantially equal to the mold clearance. Where the support force was further increased, the sheet thickness remained the same. This result indicates that by adjusting (increasing) the support force of the support portion 421, it is possible to increase the thickness of the body preform 20*a* to a value equal to the mold clearance. It is clear that in the second compression drawing, where the support force of the support portion 421 is equal to or greater than about 15 kN, the average thickness of the circumferential wall of the body increases over that in the first compression drawing which is the previous step.

FIG. 9 is a graph illustrating the relationship between the value of the compressive pressure during the compression drawing, the die shoulder radius, and the thickness of the body preform 20*a*. In FIG. 7, the compressive pressure (a value obtained by dividing the compressive force 42*a* applied to the body preform 20*a* by the cross-sectional area of the circumferential wall of the body preform 20*a*) ($N/mm^2$) is plotted against the ordinate, and a value obtained by dividing the die shoulder radius (mm) by the thickness (mm) of the body preform 20*a* [(die shoulder radius (mm))/(thickness (mm) of the circumferential wall of the body preform 20*a* prior to drawing performed by applying the compressive force)] is plotted against the abscissa.

The cross-sectional area of the circumferential wall by which the compressive force 42*a* is herein divided means the cross-sectional area of the circumferential wall which has the smallest thickness (minimum-thickness portion of the circumferential wall). This is because the minimum-thickness portion of the circumferential wall is most affected by the buckling caused by the compressive force 42*a*. The minimum-thickness portion of the circumferential wall can be located in the center of the circumferential wall along the depth direction or on the periphery thereof. This is because the zone from the portion, in which a transition is made from the top wall to the circumferential wall, to the vicinity of the circumferential wall center is acted upon by a tensile force in the drawing process and the thickness thereof decreases, whereas the zone from the vicinity of the circumferential wall center to the flange end is acted upon by the compressive force caused by shrinkage flange deformation and the thickness thereof increases. Likewise, the thickness of the circumferential wall of the body preform 20*a*, by which the die shoulder radius is divided, also means the minimum thickness of the circumferential wall.

Where the compressive pressure denoted by P and the ratio of the die shoulder radius (mm) to the thickness (mm) of the circumferential wall of the body preform 20*a* denoted by x, where the compressive pressure took a value above the curve represented by $P=130x^{0.3}$, buckling occurred in the body preform 20*a* and a sound formed material 1 could not be obtained. Further, where the compressive pressure took a value below the curve represented by $P=163x^{-1.2}$, the decrease in thickness of the body preform 20*a* caused by the drawing process could not be suppressed.

Thus, it is clear that where the condition of $163x^{-1.2} \leq P \leq 130x^{0.3}$ is fulfilled in each compression drawing step, it is possible to draw the body preform 20*a* without causing buckling or thickness reduction in the body preform 20*a*. This result makes it clear that it is preferred that the compressive pressure during each compression drawing step fulfill the condition of $163x^{-1.2} \leq P \leq 130x^{0.3}$. Further, "the thickness of the circumferential wall of the body preform 20*a* prior to drawing performed by applying the compressive force", as referred to herein, means the thickness of the circumferential wall of the body preform 20*a* after the preliminary drawing and before the first compression drawing when the compressive pressure of the first compression drawing is determined, means the thickness of the circumferential wall of the body preform 20*a* after the first compression drawing and before the second compression drawing when the compressive pressure of the second compression drawing is determined, and means the thickness of the circumferential wall of the body preform 20*a* after the second compression drawing and before the third compression drawing when the compressive pressure of the third compression drawing is determined.

When the compressive pressure took a value on the curve represented by $P=130x^{0.3}$ or $P=163x^{-1.2}$, the thickness of the circumferential wall of the body preform 20*a* after the compression drawing was about the same as the thickness of the circumferential wall of the body preform 20*a* before the compression drawing. When the compressive pressure fulfilled the condition of $163x^{-1.2}<P<130x^{0.3}$, the thickness of the circumferential wall of the body preform 20*a* after the compression drawing was greater than the thickness of the circumferential wall of the body preform 20*a* before the compression drawing.

The molding is impossible in a region with a small x (=(die shoulder radius (mm))/(thickness (mm) of the body preform 20*a*)) for the following reason. Since the die shoulder radius is less than the thickness of the circumferential wall of the body preform 20*a*, the resistance to bending-unbending deformation at the time the material passes by the die shoulder is large and the reduction in thickness easily advances, which apparently results in a wide thickness-reduced region.

Figure 10:
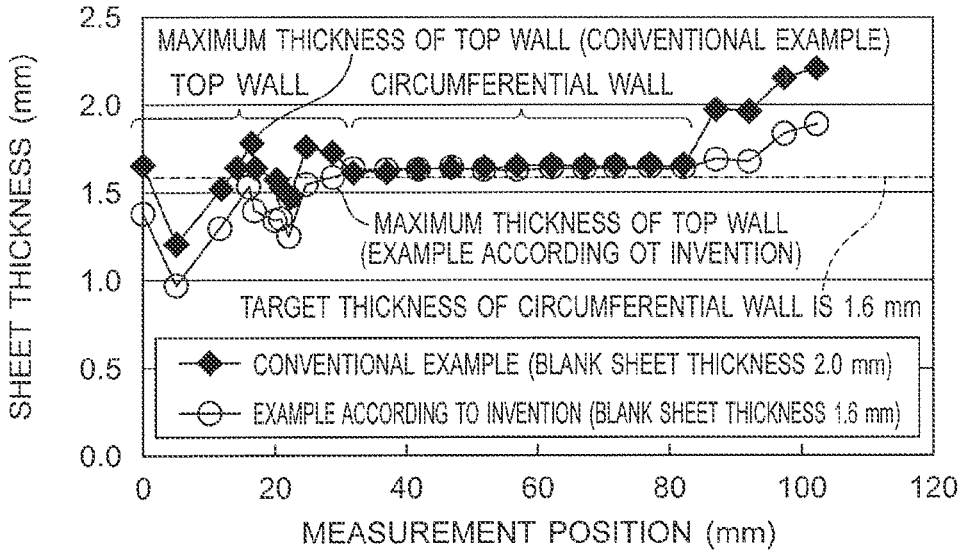
FIG. 10 is a graph illustrating the thickness of the formed material manufactured by the formed material manufacturing method of the present embodiment.
Figure 11:
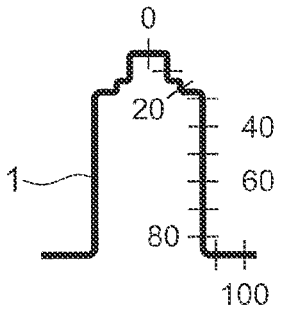
FIG. 11 illustrates the thickness measurement position in FIG. 10.

FIG. 10 is a graph illustrating the thickness of the formed material manufactured by the formed material manufacturing method of the present embodiment. FIG. 11 illustrates the thickness measurement position in FIG. 10. The inventors used a round sheet (thickness 1.6 mm, diameter 116 mm) of a cold-rolled sheet of normal steel that was plated with Zn—Al—Mg as the blank metal sheet 2, and attempted to manufacture a formed material with a thickness of 1.6 mm in the circumferential wall 101 of the body 10. As depicted in FIG. 10, it was confirmed that by using the formed material manufacturing method of the present embodiment it is possible to manufacture a formed material with a thickness (thickness at a measurement position of 30 mm to 80 mm) of the circumferential wall 101 of 1.6 mm by using the blank metal sheet 2 with a thickness of 1.6 mm. It was also confirmed that a formed material can be manufactured in which the circumferential wall 101 (thickness at a measurement position of 30 mm to 80 mm) has a thickness larger than the maximum thickness (maximum thickness at a measurement position of 0 mm to 29 mm) of the top wall 100.

Further, as depicted in FIG. 10, with the conventional method (the usual multistage drawing in which the compressive force 42*a* is not applied), a blank metal sheet 2 with a thickness of 2.0 mm is needed to manufacture the formed material with a thickness of the circumferential wall 101 of 1.6 mm. The thickness of the flange of the formed material (example of the present invention) manufactured by the conventional method is larger than the thickness of the flange of the formed material (present invention) manufactured by the formed material manufacturing method of the present embodiment. Further, the thickness of the top wall in the conventional example is larger than the thickness of the top wall 100 in the example of the present invention. This is the result of the difference in thickness between the blank metal sheets 2 which are used in the two examples. Thus, by manufacturing a formed material by the formed material manufacturing method of the present embodiment, it is possible to prevent the flange thickness from increasing unnecessarily. The weight in the example of the present invention was reduced by about 10% with respect to that in the conventional example.

With such a formed material manufacturing method, the body 10 is formed by drawing the body preform 20*a* while applying the compressive force 42*a* along the depth direction of the body preform 20*a* to the body preform 20*a*. As a result, thickness reduction of the body 10 caused by the drawing process can be avoided, and the necessary thickness of the body 10 can be ensured even by using a blank metal sheet 2 which is thinner than that in the conventional methods. Further, since the first to third compression drawings are performed such as to be completed before the pad portion 420 reaches bottom dead center, and the adjustable support force of the support portion 421 acts as the compressive force 42*a* upon the body preform 20*a* when the body preform 20*a* is drawn, even when the processing conditions are changed or the thickness of the blank metal sheet is changed, the process can be flexibly adapted to those changes. As a result, unnecessary increases in the thickness of the flange 11 can be avoided, the process can be flexibly adapted to changes in the processing conditions or thickness of the blank metal sheet 2, and the formed material 1 can be efficiently reduced in weight. The present features are particularly useful in applications in which weight reduction of the formed material is required, such as motor cases. Further, at the same time as the weight of the formed material 1 is reduced, the material cost can be also reduced.

Where the compressive force 42*a* is denoted by P and the ratio of the die shoulder radius (mm) to the thickness (mm) of the circumferential wall of the body preform 20*a* before the compressive force 42*a* is applied and the drawing is performed is denoted by x, the condition of $163x^{-1.2}\leq P\leq 130x^{0.3}$ is fulfilled. The body preform 20*a* can be drawn without causing buckling and thickness reduction in the body preform 20*a*.

Further, since the thickness of the circumferential wall 101 is equal to or greater than at least one of the thickness of the blank metal sheet 2 and the maximum thickness of the top wall 100, the body preform 20*a* can be drawn while avoiding unnecessary thickening of the top wall 100 and the flange 11 even when a thin blank metal sheet 2 is used.

In the embodiment, a case is explained in which the compression drawing is performed in three stages, but the number of compression drawing stages may be changed, as appropriate, according to the size of the formed material 1 or the dimensional accuracy required.

The invention claimed is:

1. A formed material manufacturing method of manufacturing a formed material having a tubular body and a flange, which is formed at an end portion of the tubular body, by performing multistage drawing of a blank metal sheet, wherein the multistage drawing includes:

performing a preliminary drawing wherein a preliminary body having a body preform is formed from the blank metal sheet, and the body preform includes a top wall and a circumferential wall protruding from an outer edge of the top wall, wherein the circumferential wall includes an exterior face, an interior face, and a lower end face extending entirely between the exterior face and the interior face, and the exterior face and the interior face extend from the top wall to the lower end face; and performing at least one compression drawing after the preliminary drawing by using a mold including a die having a press-in hole, a punch inserted into the body preform to press the body preform into the press-in hole, and pressurization means for applying a compressive force along a depth direction of the body preform to the circumferential wall of the body preform, and in which the tubular body is formed by drawing the body preform while applying the compressive force to the circumferential wall of the body preform;

wherein the pressurization means is a lifter pad having a pad portion disposed at the outer circumferential position of the punch so as to face the die and onto which the lower end face of the circumferential wall of the body preform is placed, and a support portion which supports the pad portion from below and is configured such that a support force that supports the pad portion can be adjusted;

completing at least one compression drawing before the pad portion reaches bottom dead center;

wherein the support force acts as the compression force upon the circumferential wall of the body preform when the drawing of the body preform is performed; and wherein the lower end face of the circumferential wall of the body preform contacts the pad portion of the pressurization means when at least one compression drawing is performed.

2. The formed material manufacturing method according to claim 1, wherein where a value ($N/mm^2$) obtained by dividing the compressive force applied to the circumferential wall of the body preform by a cross-sectional area of the circumferential wall of the body preform is denoted by P and a ratio of the die shoulder radius (mm) to the thickness (mm) of the circumferential wall of the body preform before the compressive force is applied and the drawing is performed is denoted by x, such that the following relationship:

$163x^{-1.2} \leq P \leq 130x^{0.3}$ is satisfied.

3. The formed material manufacturing method according to claim 1, wherein the tubular body includes a top wall and a circumferential wall protruding from an outer edge of the top wall; and the thickness of the circumferential wall of the tubular body is equal to or greater than a maximum thickness of the top wall of the tubular body.

* * * * *